US009801790B2

(12) United States Patent
Hessler

(10) Patent No.: US 9,801,790 B2
(45) Date of Patent: Oct. 31, 2017

(54) ENHANCED MEDICINE CUP WITH A SIPPING STRAW FOR USE WITH A MEDICINE BOTTLE

(71) Applicant: LeAnn Hessler, Ebensburg, PA (US)

(72) Inventor: LeAnn Hessler, Ebensburg, PA (US)

( * ) Notice: Subject to any disclaimer, the term of this patent is extended or adjusted under 35 U.S.C. 154(b) by 0 days.

(21) Appl. No.: 14/635,632

(22) Filed: Mar. 2, 2015

(65) Prior Publication Data

US 2016/0256355 A1 Sep. 8, 2016

(51) Int. Cl.
*A61J 7/00* (2006.01)

(52) U.S. Cl.
CPC ..... *A61J 7/0046* (2013.01); *A61J 7/0038* (2013.01)

(58) Field of Classification Search
CPC ..... A61J 7/00; A61J 7/0015; A61J 7/0038; A61J 7/0046; A61J 7/006; B65D 41/32; B65D 41/56; B65D 77/28; B65D 77/286
See application file for complete search history.

(56) References Cited

U.S. PATENT DOCUMENTS 293,190 A * 2/1884 Moore ..... A47G 19/2266 215/389
1,986,741 A * 1/1935 Moser ..... G01F 19/00 141/381
2,185,699 A * 1/1940 Zeugner ..... G01F 19/00 141/381
2,355,010 A * 8/1944 Pera ..... A47G 19/2266 215/388
2,804,103 A * 8/1957 Wall ..... G01F 11/262 141/381
2,885,134 A * 5/1959 Cohen ..... A47G 19/2266 206/515
3,144,976 A 8/1964 Freshour
3,173,566 A * 3/1965 Talbert ..... B65D 77/283 215/229
3,332,567 A 7/1967 Pugh, Sr.
3,351,241 A * 11/1967 Wood ..... A61J 7/0046 222/158
3,406,868 A * 10/1968 Rogers ..... A47G 19/2266 220/710

(Continued)

OTHER PUBLICATIONS

Web link: http://sippysure.com/description.html Downloaded Aug. 25, 2014 Sippy Sure—the medicine dispensing sippy cup.

(Continued)

*Primary Examiner* — Andrew Gilbert
(74) *Attorney, Agent, or Firm* — Russ Weinzimmer & Associates, PC

(57) ABSTRACT

An enhanced medicine cup for use with a medicine bottle is disclosed, the medicine cup having a sipping straw running along a sidewall of the cup, the straw enabling a person to easily sip medicine from the bottom of the cup. The sipping straw extends upward beyond the sidewall, having a first opening at it's top end, and extends downward along the sidewall, being sealed at it's bottom end, and having instead a second opening near its bottom end in its sidewall that is in fluid communication with the inside of the cup via a corresponding opening near the bottom of the cup. Retaining protrusions are provided around the inner surface of the sidewall of the cup that engage with a cooperative ridge on the outer surface of a cap or a neck of a medicine bottle so as to removably retain the enhanced medicine cup on the medicine bottle.

8 Claims, 2 Drawing Sheets

(56) References Cited

U.S. PATENT DOCUMENTS 3,774,804 A * 11/1973 Henning ..... A47G 19/2266 220/705
4,230,230 A * 10/1980 Mumford ..... B65D 41/18 215/277
4,437,576 A * 3/1984 Barniak ..... B65D 47/286 220/710
4,606,481 A * 8/1986 Conti ..... A47J 47/02 222/562
4,834,251 A * 5/1989 Yu ..... B65D 41/06 215/222
4,951,839 A * 8/1990 Kong ..... G01F 11/26 141/322
5,005,717 A * 4/1991 Oilar ..... A47G 19/2272 215/13.1
5,039,012 A * 8/1991 Inaba ..... A47G 21/18 215/388
5,174,478 A * 12/1992 Reyman ..... B67D 1/0001 222/207
5,222,940 A 6/1993 Wilk
5,259,536 A * 11/1993 Reyman ..... B67D 1/0001 222/207
D373,050 S * 8/1996 Brewer ..... D7/505
5,718,681 A 2/1998 Manning
5,884,758 A 3/1999 Sigouin et al.
6,126,632 A * 10/2000 Verbovszky ..... A47G 19/2266 220/712
6,904,867 B2 * 6/2005 Zamjahn ..... G09F 11/23 116/308
D516,864 S * 3/2006 Kleckauskas ..... D7/507
7,108,676 B2 9/2006 Loging
7,296,700 B2 * 11/2007 Steele, IV ..... B65D 23/102 206/828
7,392,916 B1 7/2008 Kuighadush
7,823,802 B1 * 11/2010 Roche ..... B65D 75/5872 239/16
8,127,789 B2 3/2012 Schafer et al.
8,939,349 B2 * 1/2015 Lerner ..... A47G 19/2266 206/217
2004/0006303 A1 1/2004 Takowsky
2006/0027675 A1 * 2/2006 Takeda ..... A47G 21/183 239/33
2007/0262164 A1 11/2007 Gelfand
2008/0296181 A1 12/2008 Stephens et al.
2008/0314914 A1 12/2008 Hacsi
2013/0118485 A1 5/2013 Shahaf
2013/0150783 A1 6/2013 Pamboukis
2014/0014612 A1 * 1/2014 Kershner ..... B65D 50/043 215/218
2014/0163463 A1 6/2014 Agbo
2014/0299613 A1 * 10/2014 Roux ..... A61J 7/0038 220/710

OTHER PUBLICATIONS

Web link: http://www.rehabmart.com/product/gravity-assisted-drinking-cup-18546.html Downloaded Aug. 25, 2014 Gravity Assisted Drinking Cup.

Web link: http://www.amazon.mk/Sip-cup-Cup-Built-Straw/dp/B00ANR6MWA Downloaded Aug. 25, 2014 Sip-a-cup with Built-in Straw.

Web link: http://www.allegromedical.com/daily-living-aids-c519/people-feeder-an-alternative-to-syringe-feeding-p193164.html Downloaded Aug. 25, 2014 People Feeder—An alternative to syringe feeding.

* cited by examiner

ENHANCED MEDICINE CUP WITH A SIPPING STRAW FOR USE WITH A MEDICINE BOTTLE

FIELD OF THE INVENTION

The present invention relates generally to medicine cups, and more particularly to medicine cups cooperative with medicine bottles.

BACKGROUND OF THE INVENTION

Medicine is dispensed in liquid form for a variety of reasons. Children are often unable to swallow pills easily, so many medicines for children are provided in liquid form using a medicine cup. Liquid medicine can often have a thick, syrupy consistency that is difficult to consume because it tends to adhere the walls of the medicine cup. As a result, a significant amount of the liquid will remain after the child has tried to consume the entire contents of the cup. When dealing with a sick child, this shortcoming leaves parents guessing as to how much liquid medicine was actually consumed. After setting the cup down, the remaining liquid medicine pools in the bottom of the cup, but it is still difficult to consume because of its high viscosity, and a sick child with a frustrated parent often do not have the patience to extract the last drops of the medicine in the cup. This wastes medicine, and results in uncertainty as to the actual dose consumed.

One approach to ensuring that a complete dose in consumed is to pour more than the recommended dosage into the cup. However, this is a bad idea because there is no easy way to know how much extra medication to add so as to ensure that the right dosage is consumed, and for some medications, adding too much will result in over-medication. Also, this approach tends to waste medication.

SUMMARY OF THE INVENTION

The present invention relates generally to an enhanced medicine cup having a sipping straw extending along and beyond the sidewall of the cup, a bottom end of the sipping straw being in fluid communication with a hole in the sidewall of the cup, the hole in the sidewall being located near the bottom of the cup so as to enable a person to sip substantially the last drops of liquid medicine contained in the cup. These last drops of liquid medicine would typically be left at the bottom of the cup due to the difficulty of consuming the last drops using the usual method of tilting the cup to facilitate sipping liquid medicine from the rim of the cup.

The present invention solves the problems described above by providing a medicine cup for use with a medicine bottle, the medicine cup having an integrated straw for sipping the last drops of medication from the medicine cup. The medicine cup has a bottom surrounded by a sidewall. The sidewall extends upward from the bottom to form a brim (top circumferential edge), the sidewall and the bottom together defining a volume of space for containing a quantity of liquid medicine. A hole through the sidewall is located at the bottom of the sidewall, the hole providing a path for liquid to exit the lower portion of the medicine cup via the sipping straw, the sipping straw having a bottom end that is sealed over the hole, and a top end that extends upwards from the brim of the medicine cup.

One general aspect of the invention is an enhanced medicine cup including: a cup with a bottom and a sidewall, the sidewall having an opening located at the bottom of the sidewall that extends through the sidewall; and a sipping straw extending along the outside of the sidewall of the cup, the sipping straw having an open top end extending above the sidewall of the cup, and a closed bottom end that extends to the bottom of the cup, the sipping straw also having a side opening near the closed bottom end that is aligned with and is in fluid communication with the opening of the cup so that fluid can move from the bottom of the cup through both the opening of the cup and the side opening of the straw when one sips via the top end of the sipping straw.

In some embodiments, the enhanced medicine cup further includes a fill line marking the side wall.

In some embodiments, the enhanced medicine cup further includes at least one retaining protrusion on an inner surface of the side wall that removably enagages with a cooperative ridge on the outer surface of a cap or with a neck of a medicine bottle, so as to removably retain the enhanced medicine cup on the medicine bottle.

In some embodiments, the at least one retaining protrusion has a substantially flat edge that contacts the underside of a cap of a medicine bottle when the medicine cup is placed over the cap and is pressed down until the flat edge is beneath the cap of the medicine bottle.

In some embodiments, multiple retaining protrusions are placed at different locations along an inner surface of the side wall of the medicine cup, each at approximately a same distance from the bottom of the cup.

In some embodiments, the bottom has a diameter, the circumferential edge has a diameter, and the diameter of circumferential edge is greater than the diameter of the bottom.

In some embodiments, the sipping straw is formed of the same material as the cup, and is integrated into the sidewall of the cup.

In some embodiments, the cup has a frusto-conical shape.

In some embodiments, the at least one retaining protrusion has a substantially horizontal edge.

In some embodiments, the at least one retaining protrusion is located at a sufficient distance from the circumferential edge to remain below a bottle cap when the medicine cup is placed upside down on top of a capped medicine bottle.

In some embodiments, the sidewall is graduated.

Another general aspect of the invention is a method of more completely ingesting medicine contained in a medicine cup. The method includes: filling a medicine cup to a fill line that is visible on the side of the medicine cup; drinking the medicine from the cup; tilting the cup so that remaining medicine pools near an opening in the side of the cup; and drinking the pooled medicine through a sipping straw running along the outside of the medicine cup and in fluid communication with the opening in the side of the cup.

BRIEF DESCRIPTION OF THE DRAWINGS

Many additional features and advantages of the present invention will become apparent to those skilled in the art upon reading the following description, when considered in conjunction with the accompanying drawings, in which.

Figure 1:
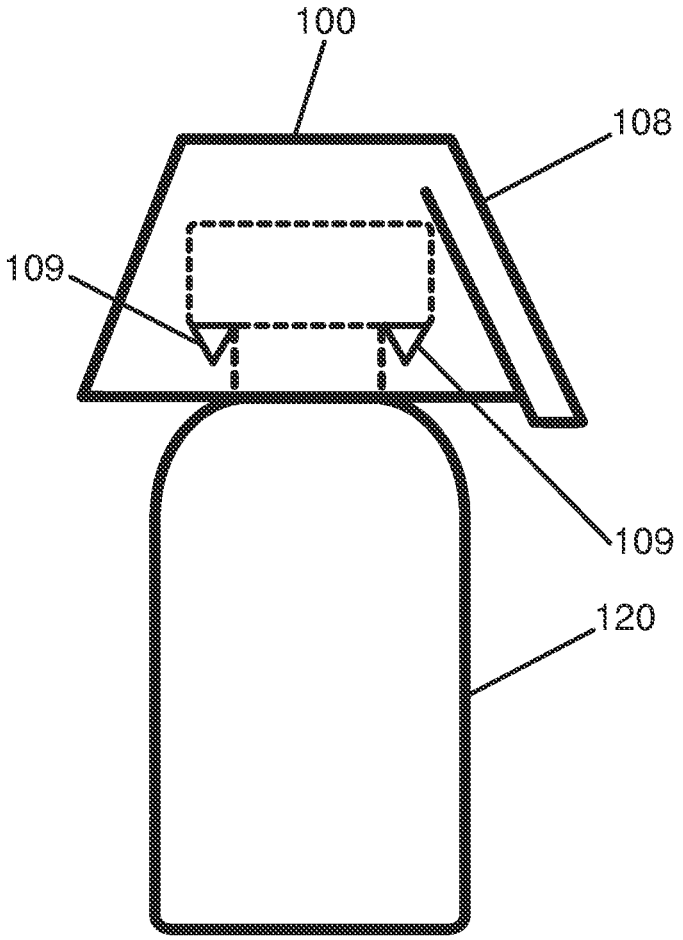
FIG. 1 is a side view of an enhanced medicine cup having a straw, also showing retaining protrusions on the inside of the cup that removably secure the cup upside down to the neck of a bottle.

DETAILED DESCRIPTION with reference to FIG. 1, a medicine cup 100 is attached to a medicine bottle 120 via retaining protrusions 109. A sipping straw 108 extends along the side of the medicine cup 100 and then extends further beyond the cup 100 to facilitate sipping from the straw 108 when the cup is taken off of the bottle 120 and filled with liquid medication.

The protrusions 109 are located on the inside of medicine cup 100 so as to retain cup 100 in a secure manner to the medicine bottle 120 by providing a surface against which the bottom lip of a cap on medicine bottle 120 can be engaged.

Figure 2:
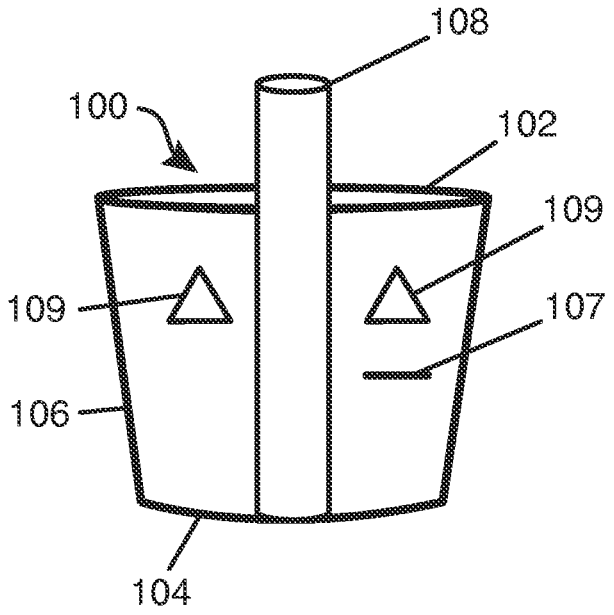
FIG. 2 is a side view of the medicine cup of FIG. 1 having a straw running along the sidewall of the cup.

Directing attention to FIG. 2, in an embodiment, medicine cup 100 is shown having a conventional, frusto-conical shape, defined by a circular, top lip 102 and bottom surface 104. The diameter of top lip 102 is greater than the diameter of bottom surface 104. However, other shapes may be used for medicine cup 100, such as cylindrical, rectangular, etc., as needed or desired. Sidewall 106 connects top lip 102 to bottom surface 104, thereby creating a space within which liquid can be contained. Various fill markers can be incorporated into the side of the cup, for example a recommended dosage may have a distinct fill marker 107, to which medicine is added to medicine cup 100 until the level reaches fill marker 105. Other quantified graduations can be added, as is known in the art. In some embodiments, sipping straw 108 is attached outside of sidewall 106, extending along its length from just above top lip 102 down to just above bottom surface 104. In other embodiments, sipping straw 108 is actually partially or completely integrated within the sidewall 106. Retaining protrusions 109, placed at various locations around the inner surface of sidewall 106, serve to retain medicine cup 100 to a medicine bottle.

Figure 3:
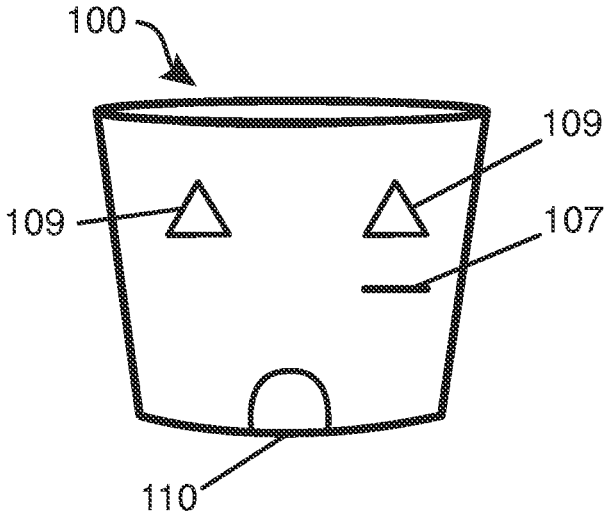
FIG. 3 is a side view of the enhanced medicine cup of FIG. 2, without the straw attached.

As shown in FIG. 3, sidewall 106 includes an opening 110 through which liquid in cup 100 passes through a corresponding opening 114 in the side of sipping straw 108.

Figure 4:
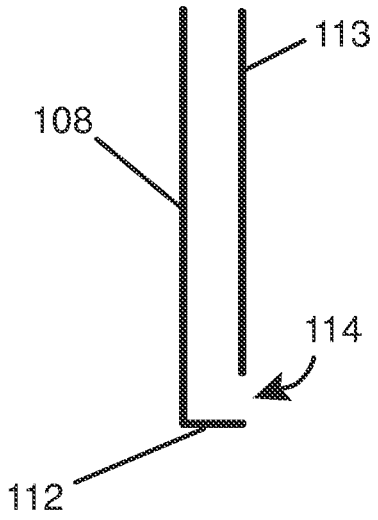
FIG. 4 is a side view of the straw of FIG. 2, without the cup attached.

Directing attention to FIG. 4, sipping straw 108 has a closed bottom end 112, open top end 113, and an aperture 114 located on the side of sipping straw 108 near closed bottom end 112. In some embodiments, the length of sipping straw 108 is bonded or otherwise secured to the side of medicine cup 100.

The user may either drink all of the contents of medicine cup 100 through sipping straw 108, or drink as much as possible from top lip 102, and then tilt the medicine cup so that any remaining medicine collects near opening 110 so that it can be pulled through sipping straw 108.

The enhanced medicine cup of the invention is useful for a person who has a neck condition, such as the elderly, who would have difficulty bending his/her head backwards to fully consume the elixir from a standard medicine cup. Instead, he/she can use the sipping straw to consume the entire contents of the medicine cup. The use of the straw would allow for greater ease of consumption of the medication without causing neck pain.

While a medicine cup with an sipping straw incorporated into the exterior wall has been illustrated and described in detail, it is to be understood that numerous changes and modifications can be made to embodiments of the present invention without departing from the spirit thereof.

What is claimed is:

1. An enhanced medicine cup comprising:

a frustoconical cup having a bottom and a sidewall, the sidewall having an outer surface forming an exposed outermost exterior wall of the cup that is exposed to ambient conditions, an inner surface, and a top circumferential edge opposite the bottom, the inner surface of the cup defining an inner volume for holding a liquid medicine and for engaging a top portion of a medicine bottle, the cup further having an opening located adjacent the bottom of the cup that extends through the sidewall; and a single piece inextensible sipping straw in fixed alignment with and formed solely along the outer surface of the sidewall of the cup in an original non-collapsed or unfolded orientation prior to use, the single piece inextensible sipping straw having an open top end extending above the outer surface of the top circumferential edge of the sidewall of the cup, and a closed bottom end having a side opening in fluid communication with the opening adjacent the bottom of the cup so that fluid can flow from the bottom of the cup through both the opening adjacent the bottom of the cup and the side opening of the single piece inextensible sipping straw when a negative pressure is applied to the open top end of the single piece inextensible sipping straw, and wherein the inner surface of the sidewall is dimensioned to engage the top portion of the medicine bottle without contacting the single piece inextensible sipping straw when the medicine cup is placed over the top portion of the medicine bottle, and wherein the single piece inextensible sipping straw remains in a non-collapsed or unfolded orientation during use.

2. The enhanced medicine cup of claim 1, further comprising:

a fill line marking the sidewall.

3. The enhanced medicine cup of claim 1, further comprising:

at least one retaining protrusion on the inner surface of the sidewall that removably engages with a cooperative ridge on an outer surface of a cap of the medicine bottle, so as to removably retain the enhanced medicine cup on the medicine bottle.

4. The enhanced medicine cup of claim 3, wherein the at least one retaining protrusion has a flat edge that contacts an underside of the cap of the medicine bottle when the medicine cup is placed over the cap of the medicine bottle and is pressed down until the flat edge is beneath the cap of the medicine bottle.

5. The enhanced medicine cup of claim 3, wherein multiple retaining protrusions are placed at different locations along the inner surface of the sidewall of the medicine cup, each at approximately a same distance from the bottom of the medicine cup.

6. The enhanced medicine cup of claim 1, wherein:

the bottom of the medicine cup has a first diameter and the circumferential edge has a second diameter, wherein the second diameter is greater than the first diameter.

7. The enhanced medicine cup of claim 3, wherein the at least one retaining protrusion is located at a sufficient distance from the circumferential edge to remain below an underside of the bottle cap when the medicine cup is placed upside down on top of the medicine bottle.

8. The enhanced medicine cup of claim 1, wherein the sidewall is graduated.

* * * * *